United States Patent [19]

Tsujiuchi et al.

[11] Patent Number: 4,490,946

[45] Date of Patent: Jan. 1, 1985

[54] GRINDING WHEEL FEEDER IN GRINDING MACHINES

[75] Inventors: Toshio Tsujiuchi, Kariya; Takao Yoneda, Toyoake; Norio Ohta, Okazaki, all of Japan

[73] Assignee: Toyoda Koki Kabushiki Kaisha, Kariya, Japan

[21] Appl. No.: 453,830

[22] Filed: Dec. 28, 1982

[30] Foreign Application Priority Data

Jan. 21, 1982 [JP] Japan ..... 57-8417

[51] Int. Cl.[3] ..... B24B 49/04

[52] U.S. Cl. ..... 51/165.88; 51/165.77; 364/474

[58] Field of Search ..... 51/165 R, 165.77, 165.87, 51/165.88, 165.91; 364/474

[56] References Cited

U.S. PATENT DOCUMENTS 4,015,372 4/1977 Fukuma ..... 51/165.88
4,148,159 4/1979 Robillard ..... 51/165.88
4,382,215 5/1983 Barlow ..... 364/474
4,420,910 12/1983 Larsson ..... 51/165.88

FOREIGN PATENT DOCUMENTS 56-163878 5/1980 Japan .

*Primary Examiner*—Harold D. Whitehead
*Attorney, Agent, or Firm*—Oblon, Fisher, Spivak, McClelland & Maier

[57] ABSTRACT

Wear on the dressing tool is derived from an amount of movement that a grinding wheel is advanced until issuance of a signal from a sizing device for correcting data on the radius of the grinding wheel. The data on the radius of the grinding wheel is thus indicative of an actual radius of the grinding wheel regardless of a variation in the grinding wheel radius due to the wear of a dressing tool. Accordingly, the grinding surface of the grinding wheel can be exactly positioned at a grinding start position after the grinding wheel has been returned to its original position upon power supply failure, emergency machine shutdown or the like, so that any unwanted interference between the grinding wheel and a workpiece can be avoided.

3 Claims, 6 Drawing Figures

GRINDING WHEEL FEEDER IN GRINDING MACHINES

BACKGROUND OF THE INVENTION

The present invention relates to a grinding wheel feeder in a grinding machine, and more particularly to a grinding wheel feeder in a grinding machine having a sizing device for controlling the grinding wheel feeder to grind a workpiece to desired dimensions.

Numerically controlled grinding machines generally include a position register for storing data on the position of the grinding surface of a grinding wheel. When the stored data is accidentally erased upon power supply failure or emergency shutoff of the machine, it becomes impossible to locate the grinding surface of the grinding wheel.

To avoid such a drawback, it has been customary to measure and store, when the grinding wheel has an initial radius, the amount that a grinding wheel base moves from its fixed original position to a grinding start position at which the grinding surface of the grinding wheel is spaced a given distance from the axis of a workpiece to be ground, and then to accumulate data items on a compensation amount that the grinding wheel base is moved each time the grinding wheel is dressed. When the data on the position of the grinding surface of the grinding wheel is lost upon power supply failure or machine shutdown in case of emergency, the grinding wheel base is returned to the original position, and then advanced by an amount of movement which is equal to the sum of the initially stored amount of travel and the compensation amount of travel that have been accumulated. This allows the grinding surface of the grinding wheel to be positioned a desired distance from the axis of the workpiece after the data on the position of the grinding surface has been erased.

In practice, however, the actual radius of the grinding wheel varies to become progressively greater than theoretical dimension as the dressing tool in worn. At the time of positioning the grinding wheel base to the grinding start position after it has been returned to the original position, the position of the grinding surface is deviated from the grinding start position by a distance corresponding to the wear amount of the dressing tool. An undue increase in such a deviation results in the danger for the grinding wheel to interfere with the workpiece in grinding operation.

SUMMARY OF THE INVENTION

Accordingly, it is an object of the present invention to provide a grinding wheel feeder which is capable of precisely positioning the grinding surface of a grinding wheel to a grinding start position after power supply failure or emergency machine shutdown by computing a change in the radius of the grinding wheel due to wear on a dressing tool as well as a reduction in the grinding wheel radius due to dressing thereof.

According to the present invention, a grinding wheel feeder in a grinding machine including a fixed workpiece axis, a grinding wheel movable between an original position and the fixed workpiece axis and having a grinding wheel axis and a grinding surface, and a dressing tool for dressing the grinding surface, comprises a position register for storing data on a distance between the fixed workpiece axis and the grinding surface, the position register having a stored content variable as the grinding wheel is moved, a sizing device for monitoring dimensions of the workpiece as it is ground, memory means for storing distance data on a distance between the fixed workpiece axis and the grinding wheel axis when the grinding wheel is at the original position and radius data on the radius of the grinding wheel, and a processing unit responsive to the content of the position register for detecting the position of the grinding surface and controlling the feeding of the grinding wheel.

The radius data stored in the memory means is rewritten as the radius of the grinding wheel is reduced each time the grinding wheel is dressed, and a wear amount of the dressing tool is computed based upon an actual feed amount which the grinding wheel is moved until a signal is issued from tbe sizing device. The radius data stored in the memory means is also rewritten in response to the computed wear amount of the dressing tool. The radius data as thus rewritten is subtracted from the distance data stored in the memory means, and the difference is set in the position register in response to the returning of the grinding wheel to the original position.

The above and other objects, features and advantages of the present invention will become more apparent from the following description when considered in conjunction with the accompanying drawings in which a preferred embodiment of the present invention is shown by way of illustrative example.

DETAILED DESCRIPTION

Figure 1:
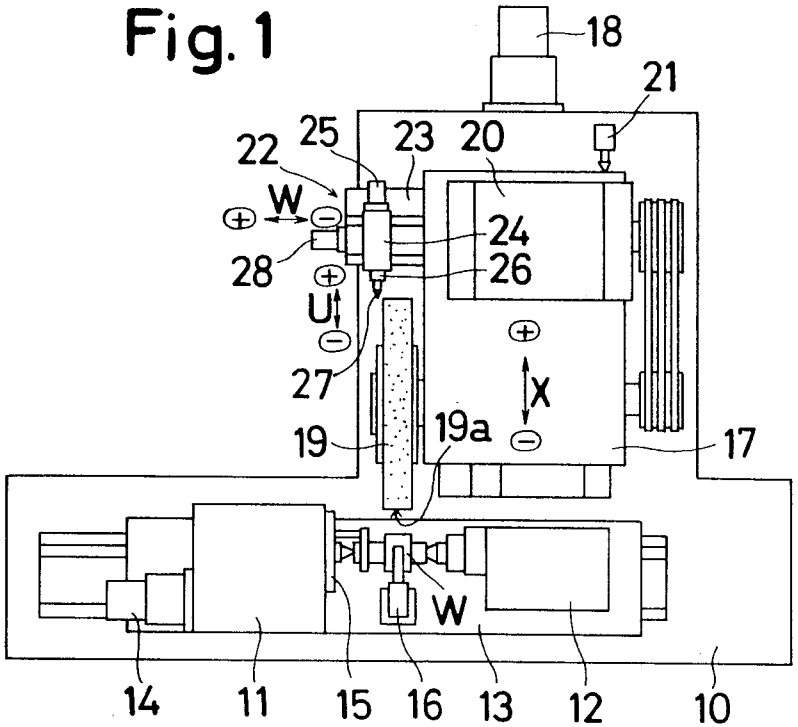
FIG. 1 is a plan view of a numerically controlled grinding machine.

As shown in FIG. 1, a numerically controlled grinding machine includes a bed 10, on which is mounted a table 13 supporting a headstock 11 and a tailstock 12 thereon. A workpiece W to be ground is supported between the headstock 11 and the tailstock 12 and can be rotated by a main spindle 15 mounted in the headstock 11 and operatively coupled to a main spindle drive motor 14. The table 13 also supports thereon a sizing device 16 for measuring the dimension of the workpiece W as it is ground. The sizing device 16 serves to generate a signal AS1 when the workpiece W is ground to a prescribed dimension, and a signal AS2 when the workpiece W is ground to a finished dimension.

A grinding wheel base 17 is mounted on the bed 10 rearward of the table 13 for back-and-forth movement in the direction of the X-axis extending perpendicularly to the axis of the workpiece W as supported between the headstock 11 and the tailstock 12. The grinding wheel base 17 is controllably fed by a feed screw (not shown) coupled to a servomotor 18. A grinding wheel 19 is rotatably journalled by the grinding wheel base 17 and can be driven to rotate by a grinding wheel drive motor 20. A grinding wheel base position detector 21 is installed on the bed 10 near its rear end for detecting the grinding wheel base 17 as the same returns to an original position.

A dresser 22 has a fixed base 23 mounted on the grinding wheel base 17, and a movable base 24 mounted on the base 23 for movement in the direction of the W-axis extending parallel to a grinding surface 19*a* of the grinding wheel 19, the movable base 24 being reciprocative movable by a servomotor 28. A ram 26 is fitted in the movable base 24 and movable back and forth in the direction of the U-axis extending perpendicularly to the axis of rotation of the grinding wheel 19. The ram 26 supports on its distal end a dressing tool 27 for dressing the grinding wheel 19. The ram 26 can be controllably moved by a feed screw (not shown) coupled to a servomotor 25. The movable base 24 supports on its rear end a dresser position detector 29 (FIG. 2) for detecting the ram 26 as the same returns to an original position.

Figure 2:
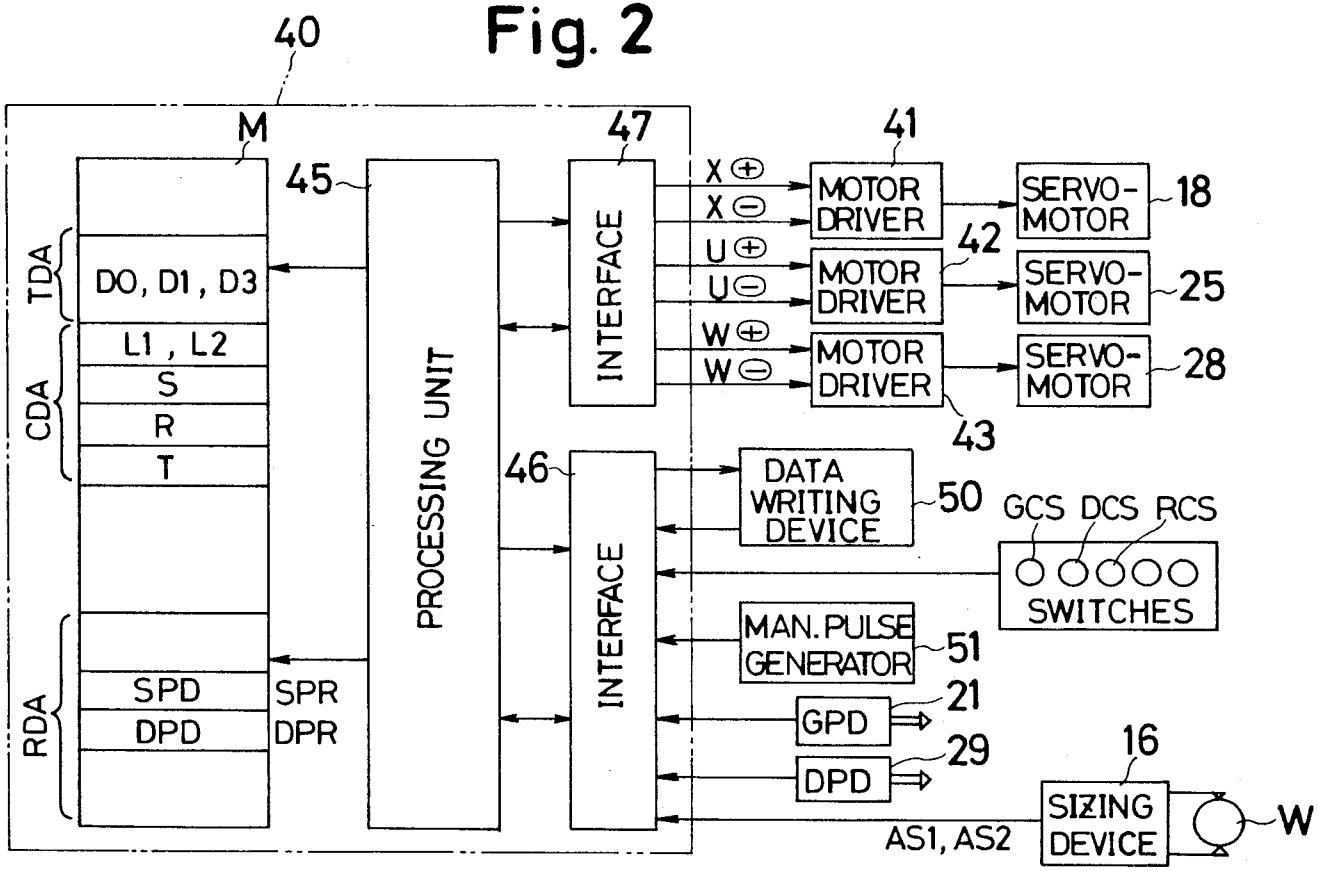
FIG. 2 is a block diagram of a control circuit for controlling the numerically controlled grinding machine shown in FIG. 1.

FIG. 2 shows a control circuit for controlling the numerically controlled grinding machine of the foregoing construction. The control circuit includes a numerical control device 40 for distributing pulses to drivers 41, 42, 43 for driving the servomotors 18, 25, 28, respectively, to control the grinding of the workpiece W and the dressing of the grinding wheel 19. The numerical control device 40 is composed of a processing unit 45, a memory M, and interfaces 46, 47 connected to the processing unit 45. To the interface 46 are connected a data writing device 50, command switches GCS, DCS, RCS for commanding starting of a grinding operation and the like, a manual pulse generator 51, the sizing device 16, and the position detectors 21, 29. The interface 47 has output terminals connected to the drivers 41, 42, 43.

The memory M has a grinding data area TDA and a control data area CDA in which data can be written by the data writing device 50, the data areas TDA, CDA being composed of core memories. Prior to grinding operations, data items D0, D1, D3 indicating a point P0 of the grinding surface 19*a* at the grinding start position, a position P1 to which the grinding surface 19*a* is fed at a rapid rate, and a position P3 where the workpiece W is ground to a desired size, respectively, in terms of distances from the axis of the workpiece W, are written into the grinding data area TDA.

Figure 3:
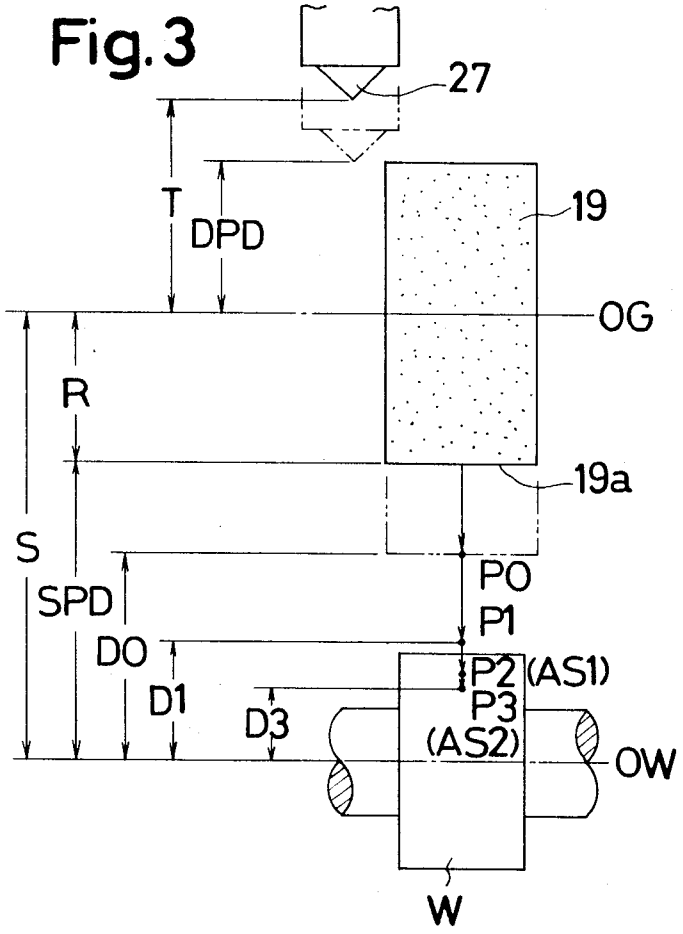
FIG. 3 is a schematic diagram illustrative of relative positions between a workpiece, a grinding wheel, and a dressing tool.

FIG. 3 illustrates relative positions between the grinding wheel 19, the workpiece W, and the dressing tool 27.

Various data items are written in the control data area CDA at the time of completing the assembing of the numerically controlled grinding machine. Such data items are indicative of an infeed amount L1 of the dressing tool 27, a traverse feed amount L2 of the dressing tool 27, an initial radius R of the grinding wheel 19, a distance S between an axis 0W of the workpiece W and an axis 0G of the grinding wheel 19 with the grinding wheel base 17 being at the original position, and a distance T between the axis 0G of the grinding wheel 19 and a tip of the dressing tool 27 as the same located at the original position.

The memory M also includes a RAM area RDA composed of a position register SPR for storing data SPD representative of a position of the grinding surface 19*a* of the grinding wheel 19 relative to the axis 0W of the workpiece W, and a position register DPR for storing data DPD indicating a dressing position of the dressing tool 27 relative to the axis 0G of the grinding wheel 19.

Operation of the numerically controlled grinding machine, particularly the processing unit 45, will now be described.

GRINDING

Figure 4:
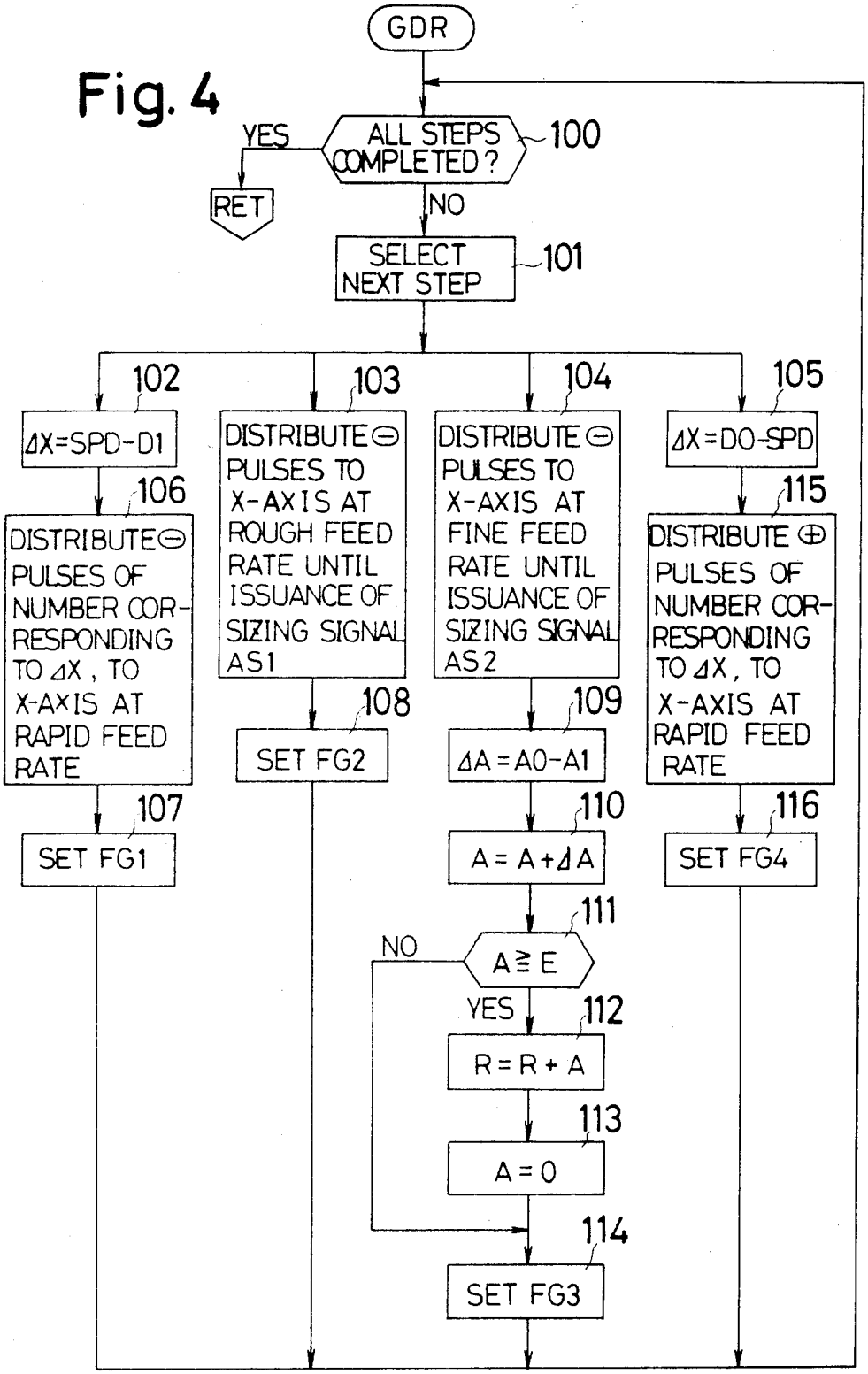
FIGS. 4 through 6 are flowcharts showing operations of a processing unit in the control unit illustrated in FIG. 2.

For grinding the workpiece W, the command switch GCS connected to the interface 46 is depressed. The processing unit 45 is responsive to a command from the command switch GCS for executing a program GDR shown in FIG. 4 grind the workpiece W.

At a step 100, the processing unit 45 determines whether all steps have been completed or not based on the status of step completion flags FG1 through FG4 associated respectively with the steps. If all steps have not yet been completed, then the processing unit 45 determines at a step 101 which grinding step it should follow depending on the status of the flags FG1–FG4, and the program goes to either one of successive steps 102 through 105.

When a grinding operation is initiated, all of the flags FG1 through FG4 have been reset, and hence the program proceeds to the step 102 for fast-foward feeding. In the step 102, the data D1 indicative of the fast-foward end position P1 is subtracted from the position data SPD stored in the position register SPR to compute an amount $\Delta X$ of fast-forward movement. At a step 106, a number of negative-going pulses corresponding to the amount $\Delta X$ are distributed at a fast speed to the driver 41 for thereby advancing the grinding wheel 19 from the grinding start position P0 at a rapid feed rate by the desired amount $\Delta X$. As the grinding wheel 19 thus moves, the position data SPD in the position register SPR is progressively reduced to indicate the position of the grinding surface 19*a* with respect to the axis 0W of the workpiece W. Thereafter, the flag FG1 is set at a step 107, and the program goes back to the step 100, and then goes to the step 103 upon determination of the grinding steps by the processing unit.

At the step 103, negative-going pulses are distributed at a rough grinding speed to the driver 41 to effect rough grinding on the workpiece W until the sizing device 16 produces the sizing signal AS1. Then, the flag FG2 is set at a step 108.

The program then goes to the step 104 for fine grinding, in which negative-going pulses are ditributed to the driver 41 for effecting fine grinding on the workpiece W. When the workpiece W is ground to a finished dimension, the sizing device 16 issues the sizing signal AS2, in response to which the distribution of the pulses to the driver 41 is stopped. An amount of travel A1 which the grinding wheel 19 is advanced from the grinding start position P0 to the finishing position is counted by a counter (not shown).

At a step 109, the actual amount of travel A1 is subtracted from a theoretical amount of travel A0 (D0−D3), which is obtained by subtracting the position data D3 at the fine grinding end position P3 from the position data DP at the grinding start position D0, to find a difference $\Delta A$. Such a difference $\Delta A$ is cumulated at a step 110 to produce an error A, which is then stored. At a step 111, the processing unit 45 determines whether the error A is greater than a present allowable value E. If the error A is smaller than the allowable value E, then the program goes to a step 114 in which the flag FG3 is set, and then proceeds to a next step. If the error A is equal to, or greater than the allowable value E, the error A is added to the grinding radius data R stored in the control data area CDA and the sum is written again in the storage area at a step 112. At a step 113, the register in which the error A is cumulatively stored is reset to indicate 0, and then the program goes to a step 114 in which the flag FG3 is set.

Accordingly, the grinding wheel radius data R can be corrected to reflect a wear amount of the dressing tool 27, as described later on.

At the step 105, the position data SPD stored in the position register SPR is subtracted from the position data D0 on the grinding start position P0 to determine an amount ΔX of fast-rearward movement. A number of positive-going pluses dependent on the determined amount ΔX are distributed at a fast feed rate to the driver 41 to retract the grinding wheel 19 by the desired amount ΔX at an increased speed to the grinding start position P0. Thereafter, the flag FG4 is set at a step 116, and the grinding operation is brought to an end.

DRESSING

Figure 5:
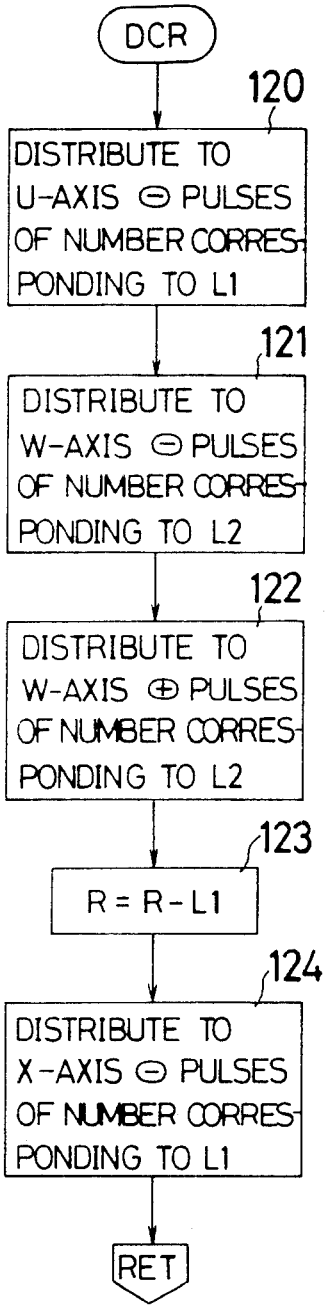

In response to depression of the dressing command switch DCS, the processing unit 45 begins to execute a program DCR illustrated in FIG. 5 for dressing the grinding wheel 19.

At a step 120, a number of negative-going pulses corresponding to the amount L1 of infeed movement are distributed to the driver 42 to force the dressing tool 27 to cut into the grinding wheel 19 in the direction of the U-axis. Then, a number of negative-going pulses corresponding to the amount L2 of traverse movement are distributed to the driver 43 at a step 121, and a number of positive-going pulses corresponding to the amount L2 of traverse movement are distributed to the driver 43 at a step 122, thereby moving the dressing tool 27 back and forth in the direction of the W-axis to dress the grinding wheel 19. Then, at a step 123, the grinding wheel radius data R stored in the control data area CDA is reduced by the amount by which the grinding wheel 19 is worn away by the dressing tool 27, that is, the amount L1 of infeed movement, and the reduced data R is stored in the storage area again. A number of negative-going pulses corresponding to the amount L1 is distributed at a step 124 to the driver 41 for compensating the position of the grinding wheel 19 for the amount L1 by which the wheel 19 has been worn away by the dressing tool 27. The dressing operation is now completed.

In this manner, each time the grinding wheel 19 is dressed, the grinding wheel radius data R stored in the control data area CDA is reduced by the amount L1 by which the dressing tool 27 cuts into the grinding wheel 19. Since the aforementioned compensation of the grinding wheel radius data R for the wear of the dressing tool 27 is also performed as mentioned earlier, the updated radius data R represents the current actual radius of the grinding wheel 19 at all times.

RETURN TO ORIGINAL POSITION

When the operation of the grinding machine is to be resumed after the stored positional data SPD on the position of the grinding surface 19*a* of the grinding wheel 19 is erased for power supply failure or emergency stop, the command switch RCS is actuated to instruct the processing unit 45 to return the grinding wheel 19 to its original position.

Figure 6:
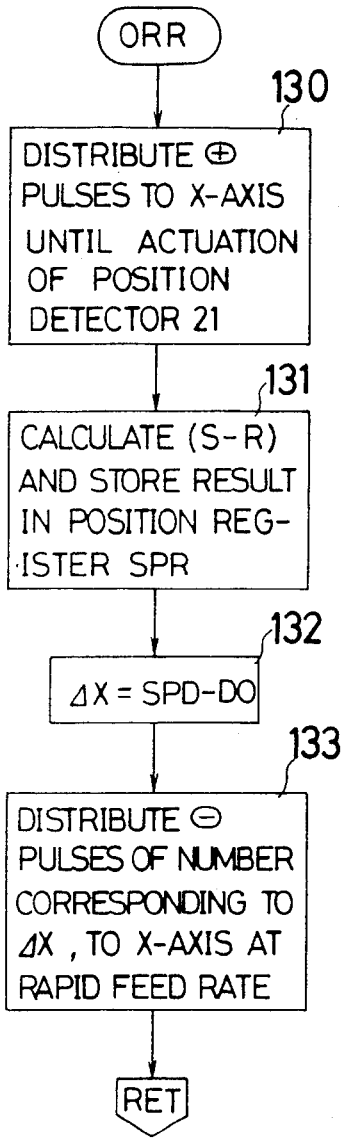

The processing unit 45 now begins executing a program ORR shown in FIG. 6 to move the grinding wheel 19 back to the original position. At a step 130, the processing unit 45 issues positive-going pulses to the driver 41 to return the grinding wheel 19 to the original position until the position detector 21 is actuated. Upon completion of the returning movement of the grinding wheel 19, the grinding wheel radius data R stored in the control data area CDA is subtracted, at a step 131, from the data on the distance S between the axis 0W of the workpiece W and the axis 0G of the grinding wheel 19 with the grinding wheel base 17 being positioned at the original position, and the resulting data is set in the position register SPR as the data SPD on the position of the grinding surface 19*a*.

Then, at a step 132, the position data D0 on the grinding start position stored in the grinding data area TDA is subtracted from the position data SPD stored in the position register SPR to find an amount ΔX of movement. The driver 41 is supplied with a number of negative-going pulses corresponding to the amount ΔX at a step 133. Therefore, the grinding wheel 19 is moved toward the workpiece W by the amount equal to the amount ΔX to position the grinding surface 19*a* at the grinding start position P0. Since the radius data R is corrected from time to time, as described above, to compensate for a reduction in the grinding wheel radius due to dressing and a variation in the grinding wheel radius due to wear on the dressing tool 27, the grinding surface 19*a* of the grinding wheel 19 can be positioned in the grinding start position P0 to a nicety without being adversely affected by such a reduction and a variation in the grinding wheel radius.

In the foregoing embodiment, the data R on the grinding wheel radius is corrected when a predetermined value is exceeded by a cumulated value of the difference between an actual interval that the grinding wheel 19 moves to reach the sizing position and a corresponding theoretical interval. However, the difference between the actual and theoretical intervals of movement may be computed only in a first cycle of grinding operation after the grinding wheel 19 has been dressed, and the radius data R may be corrected each time such a difference is produced.

While in the illustrated embodiment the present invention has been shown and described as being applied to a grinding machine in which a grinding wheel is movable back and forth in a direction perpendicular to the axis of a workpiece to be ground, the invention is equally applicable to a numerically controlled grinding machine of the angular slide type in which a grinding wheel is reciprocative movable in a direction inclined with respect to the axis of a workpiece.

With the arrangement of the present invention, wear on the dressing tool is derived from an amount of movement that the grinding wheel is advanced until issusance of a signal from the sizing device, and is used to correct data on the radius of the grinding wheel. The data on the radius of the grinding wheel is thus indicative of an actual radius of the grinding wheel regardless of a variation in the grinding wheel radius due to the wear on the dressing tool. Accordingly, the grinding surface of the grinding wheel can be positioned exactly to the grinding start position after the grinding wheel has been returned to the original position thereof upon power supply failure or the like, so that any unwanted interference between the grinding wheel and the workpiece can be avoided.

Although a certain preferred embodiment has been shown and described, it should be understood that many changes and modifications may be made therein without departing from the scope of the appended claims.

What is claimed is:

1. A grinding wheel feeder in a grinding machine having support means for carrying a workpiece to be rotatable about a fixed workpiece axis, a wheel base rotatably carrying a grinding wheel and movable between an original position and the fixed workpiece axis, and dressing means with a dressing tool for dressing the grinding surface of the grinding wheel, comprising:

a position register for storing first distance data on a distance between the fixed workpiece axis and the grinding surface, said position register being capable of varying the first distance data as the wheel base is moved;

a sizing device for monitoring dimensions of the workpiece as it is ground;

memory means for storing second distance data on a distance between the fixed workpiece axis and the axis of said grinding wheel when the wheel base is at the original position and radius data on the radius of the grinding wheel;

first rewriting means for rewriting the radius data stored in the memory means each time the radius of the grinding wheel is reduced by dressing;

computing means for computing a wear amount of the dressing tool based upon an actual feed amount which the wheel base is moved until a signal is issued from the sizing device;

second rewriting means for rewriting the radius data stored in said memory means based upon the wear amount computed by the computing means so that the rewritten radius data represents a current radius of the grinding wheel;

returning means for returning the wheel base to the original position in response to a return command which is given after the loss of the first distance data from the position register causes a grinding start position of the wheel base to become unknown;

subtracting means for subtracting the radius data rewritten by the first and second rewriting means from the second distance data stored in the memory means and for setting a difference between the second distance data and the radius data in the position register in response to the returning of the grinding wheel to the original position; and means responsive to the content of the position register for controlling feed movement of the wheel base so as to move the wheel base from the original position to the grinding start postiion.

2. A grinding wheel feeder as set forth in claim 1, wherein said dressing means is operable each time a number of grinding operations are performed, and wherein the computing means comprises:

first calculating means for obtaining a unit wear amount of the dressing tool in a first grinding operation subsequent to each dressing operation and a unit wear amount of the grinding wheel in each grinding operation after said first grinding operation, by calculating a difference between the actual feed amount and a theoretical feed amount which the wheel base is to be moved until the signal is issued from the sizing device; and second calculating means for calculating a combined wear amount of the dressing tool and the grinding wheel by adding to a previous combined wear amount each of the unit wear amounts calculated by the first calculating means.

3. A grinding wheel feeder as set forth in claim 2, wherein said second rewriting means comprises:

judging means for judging whether or not the combined wear amount calculated by the second calculating means exceeds a predetermined value; and data rewritng means for rewritng the radius data stored in the memory means by adding the predetermined value thereto when the judging means determines that the combined wear amount calculated by the second calculating means has exceeded the predetermined value.

* * * * *